US010989504B1

(12) United States Patent
Howell et al.

(10) Patent No.: US 10,989,504 B1
(45) Date of Patent: Apr. 27, 2021

(54) COMPETITIVE SHOOTING TARGET ASSEMBLY

(71) Applicant: Dick's Sporting Goods, Inc., Coraopolis, PA (US)

(72) Inventors: Jacob Ray Howell, Kent, OH (US); William E. Clegg, Gibsonia, PA (US)

(73) Assignee: Dick's Sporting Goods, Inc., Coraopolis, PA (US)

( * ) Notice: Subject to any disclaimer, the term of this patent is extended or adjusted under 35 U.S.C. 154(b) by 0 days.

(21) Appl. No.: 16/592,849

(22) Filed: Oct. 4, 2019

(51) Int. Cl.
*F41J 7/04* (2006.01)
*F41J 1/10* (2006.01)

(52) U.S. Cl.
CPC .. *F41J 7/04* (2013.01); *F41J 1/10* (2013.01)

(58) Field of Classification Search
CPC ..... F41J 1/10; F41J 7/04
See application file for complete search history.

(56) References Cited

U.S. PATENT DOCUMENTS 434,522 A 8/1890 Pederson
966,056 A 8/1910 Root
1,616,270 A 2/1927 Madden
D245,798 S 9/1977 Norden
D254,017 S 1/1980 Norden
D257,779 S 1/1981 Sippola
4,949,980 A * 8/1990 Hoy ..... F41J 7/04 273/391
5,263,722 A 11/1993 Rosellen
5,288,275 A * 2/1994 St. Peter ..... A63D 3/00 273/127 D
5,324,043 A 6/1994 Estrella
5,584,480 A * 12/1996 Grimsrud ..... A63B 71/023 273/396
6,398,215 B1 6/2002 Carroll
6,478,301 B1 * 11/2002 Witmeyer ..... F41J 7/04 273/378

(Continued)

FOREIGN PATENT DOCUMENTS

CN 105135951 A 12/2015

OTHER PUBLICATIONS

Information about Related Patents and Patent Applications, see section 6 of the accompanying Information Disclosure Statement Letter, which concerns Related Patents and Patent Application.

(Continued)

*Primary Examiner* — Eugene L Kim
*Assistant Examiner* — Christopher Glenn
(74) *Attorney, Agent, or Firm* — Fox Rothschild LLP

(57) ABSTRACT

A shooting target assembly includes a frame having a curved edge, where a plurality of catch mechanisms are positioned along the curved edge, a first target arm having a first end and a second end, and a second target arm having a first end and a second end. The first end of the first target arm is connected to a first target that is positioned above the curved edge. The second end of the first target arm is pivotally connected to a rear portion of the frame at a first pivot point. The first end of the second target arm is connected to a second target that is positioned above the curved edge, and the second end of the second target arm is pivotally connected to the rear portion of the frame at a second pivot point. Each of the plurality of catch mechanisms is configured to engage the first target arm or the second target arm.

20 Claims, 7 Drawing Sheets

(56) References Cited

U.S. PATENT DOCUMENTS

| | | | | |
|---|---|---|---|---|
| 6,896,267 | B1 | 5/2005 | Le Anna | |
| 6,983,938 | B2 | 1/2006 | Goldsmith | |
| 6,994,349 | B2 | 2/2006 | Lambert et al. | |
| 6,994,398 | B2 | 2/2006 | Gross | |
| 7,052,012 | B2 | 5/2006 | Dehart | |
| 7,114,725 | B2 * | 10/2006 | Camp | F41J 1/10 273/390 |
| 7,128,321 | B1 | 10/2006 | Brown | |
| 7,134,977 | B2 * | 11/2006 | Campbell | A63B 63/06 473/454 |
| 7,219,897 | B2 * | 5/2007 | Sovine | F41J 1/10 273/390 |
| 7,306,229 | B2 | 12/2007 | Rolfe | |
| 7,611,147 | B2 | 11/2009 | Sheldon | |
| 7,690,656 | B2 | 4/2010 | Saunders | |
| 7,731,197 | B2 | 6/2010 | Stutz | |
| 7,988,155 | B2 | 8/2011 | Wyrick et al. | |
| 8,172,231 | B2 | 5/2012 | Massier | |
| 8,444,150 | B1 * | 5/2013 | Stirtz | A63B 67/06 273/390 |
| 8,807,570 | B1 * | 8/2014 | Zalar | F41J 7/04 273/390 |
| 8,960,677 | B2 * | 2/2015 | Mickelson | F41J 1/10 273/407 |
| 9,163,912 | B1 | 10/2015 | Stark | |
| 9,228,809 | B1 * | 1/2016 | Relyea | F41J 9/02 |
| 9,303,959 | B2 | 4/2016 | Doria | |
| 9,446,301 | B2 | 9/2016 | Leimberer | |
| 9,513,091 | B2 | 12/2016 | Roberts | |
| 9,541,356 | B2 | 1/2017 | Bullis | |
| 9,574,855 | B2 | 2/2017 | Davis | |
| D815,241 | S | 4/2018 | Woller | |
| 10,119,795 | B2 | 11/2018 | Daub et al. | |
| D878,469 | S | 3/2020 | Kinner | |
| 2004/0195775 | A1 * | 10/2004 | Goldsmith, Jr. | F41J 7/04 273/392 |
| 2004/0201172 | A1 * | 10/2004 | Goldsmith | F41J 7/04 273/391 |
| 2004/0239035 | A1 * | 12/2004 | Lambert | F41J 7/04 273/348 |
| 2009/0256314 | A1 * | 10/2009 | Kobett | F41J 1/10 273/407 |
| 2010/0225063 | A1 * | 9/2010 | Wyrick | F41J 7/00 273/390 |
| 2011/0163503 | A1 * | 7/2011 | Townsend | F41J 5/18 273/355 |
| 2011/0227288 | A1 | 9/2011 | Krickovic | |
| 2013/0207347 | A1 * | 8/2013 | Sovine | F41J 7/04 273/390 |
| 2015/0130136 | A1 * | 5/2015 | Bliehall | F41J 5/20 273/391 |
| 2015/0260487 | A1 * | 9/2015 | Steil | F41J 5/14 273/390 |
| 2015/0268013 | A1 * | 9/2015 | Heise | F41J 1/10 273/389 |
| 2015/0285593 | A1 | 10/2015 | Dribben | |
| 2016/0018197 | A1 * | 1/2016 | Dyck | F41J 7/04 273/390 |
| 2016/0195369 | A1 * | 7/2016 | Perry | F41J 5/04 434/19 |
| 2016/0213989 | A1 | 7/2016 | Fristaczki | |

OTHER PUBLICATIONS

"Do-All Outdoors—Black Back Auto Resetting Steel Target, Rated for 9mm—30-06 Caliber," [online], Do-All Outdoors, [Product available on Feb. 17, 2015], https://www.amazon.com/dp/B00N247W7K/.

"Michael Bane Talks About Action Target's Rimfire Stell" [online], Action Target, published on May 2, 2013, https://www.youtube.com/watch?v=VO1ki4YO3IE.

* cited by examiner

COMPETITIVE SHOOTING TARGET ASSEMBLY

BACKGROUND

Shooting targets are typically used by marksmen to improve their aim and precision. Most targets include scoring rings with a bulls-eye representing the center of the target. As such, where a bullet impacted a target can be ascertained from where the mark is on the target.

In addition to individual-use scenarios, shooting targets may also be used in competitive shooting situations involving two or more participants. While the participants can compare targets to see which participant has better aim or precision, it may be desirable to also measure a participant's speed in addition to aim and precision.

The shooting target assembly described in this disclosure is generally directed to a competitive shooting game for two players or two teams of players that measures not only the players' aim and shooting precision, but also their quickness.

SUMMARY

In an embodiment, a shooting target assembly includes a frame having a curved edge, where a plurality of catch mechanisms are positioned along the curved edge, a first target arm having a first end and a second end, and a second target arm having a first end and a second end. The first end of the first target arm is connected to a first target that is positioned above the curved edge. The second end of the first target arm is pivotally connected to a rear portion of the frame at a first pivot point. The first end of the second target arm is connected to a second target that is positioned above the curved edge, and the second end of the second target arm is pivotally connected to the rear portion of the frame at a second pivot point. Each of the plurality of catch mechanisms is configured to engage the first target arm or the second target arm.

The plurality of catch mechanisms may include protrusions connected to the upper edge. The second end of the first target arm may be connected to a torsion spring. The torsion spring may be configured to rotate the first target arm about the first pivot point when the first target arm is not engaged by one of the plurality of catch mechanisms.

The second end of the second target arm may be connected to a torsion spring. The torsion spring may be configured to rotate the second target arm about the second pivot point when the second target arm is not engaged by one of the plurality of catch mechanisms.

The shooting target assembly may include a first bar connected to the rear portion of the frame, where the first bar extends over the first target arm. At least a portion of the first bar may be configured to restrict movement of the first target arm. The shooting target assembly may include a second bar connected to the rear portion of the frame, where the second bar extends over the second target arm. At least a portion of the second bar may be configured to restrict movement of the second arm.

The shooting target assembly may include a curved bar connected to the rear portion of the frame, where the curved bar is configured to restrict movement of the first arm and the second arm. The shooting target assembly may include a base portion attached to at least a portion of a bottom portion of the frame such that the frame is positioned at an angle relative to the base portion.

The shooting target assembly may include one or more legs connected to the base portion.

The first target arm may include a first portion configured to extend along at least a portion of the rear portion of the frame, a second portion attached to the first portion, where the second portion is configured to extend along at least a second portion of the rear portion of the frame, a third portion attached to the second portion, where the second portion is angled relative to the second portion and is configured to extend over the curved edge, and a fourth portion attached to the third portion, where the fourth portion is angled relative to the third portion and is configured to extend above the curved edge. The first target may be connected to the fourth portion.

The second target arm may include a first portion configured to extend along at least a portion of the rear portion of the frame, a second portion attached to the first portion, where the second portion is configured to extend along at least a second portion of the rear portion of the frame, a third portion attached to the second portion, where the third portion is angled relative to the second portion and is configured to extend over the curved edge, and a fourth portion attached to the third portion, where the fourth portion is angled relative to the third portion and is configured to extend above the curved edge. The second target may be connected to the fourth portion.

In an embodiment, a shooting target assembly may include a frame having a curved edge, where a plurality of catch mechanisms are positioned along the curved edge, a first target arm having a first end and a second end, and a second target arm having a first end and a second end. The first end of the first target arm is connected to a first target that is positioned above the curved edge, and the second end of the first target arm is pivotally connected to a rear portion of the frame at a first pivot point. The first end of the second target arm is connected to a second target that is positioned above the curved edge, and the second end of the second target arm is pivotally connected to the rear portion of the frame at a second pivot point. At least one bar is mounted to the rear portion of the frame such that the at least one bar extends over at least one of the first target arm or the second target arm. Each of the plurality of catch mechanisms is configured to engage the first target arm or the second target arm.

The plurality of catch mechanisms include protrusions connected to the upper edge. The second end of the first target arm may be connected to a torsion spring, where the torsion spring may be configured to rotate the first target arm about the first pivot point when the first target arm is not engaged by one of the plurality of catch mechanisms.

The second end of the second target arm may be connected to a torsion spring, where the torsion spring may be configured to rotate the second target arm about the second pivot point when the second target arm is not engaged by one of the plurality of catch mechanisms.

The shooting target assembly may include a base portion attached to at least a portion of a bottom portion of the frame such that the frame is positioned at an angle relative to the base portion, and one or more legs connected to the base portion.

The first target arm may include a first portion configured to extend along at least a portion of the rear portion of the frame, a second portion attached to the first portion, where the second portion is configured to extend along at least a second portion of the rear portion of the frame, a third portion attached to the second portion, where the second portion is angled relative to the second portion and is configured to extend over the curved edge, and a fourth portion attached to the third portion, where the fourth portion is angled relative to the third portion and is configured to extend above the curved edge. The first target may be connected to the fourth portion.

The second target arm may include a first portion configured to extend along at least a portion of the rear portion of the frame, a second portion attached to the first portion, where the second portion is configured to extend along at least a second portion of the rear portion of the frame, a third portion attached to the second portion, where the third portion is angled relative to the second portion and is configured to extend over the curved edge, and a fourth portion attached to the third portion, where the fourth portion is angled relative to the third portion and is configured to extend above the curved edge. The second target may be connected to the fourth portion.

DETAILED DESCRIPTION

As used in this document, the singular forms "a," "an," and "the" include plural references unless the context clearly dictates otherwise. Unless defined otherwise, all technical terms used herein have the same meanings as commonly understood by one of ordinary skill in the art. As used in this document, the term "comprising" (or "comprises") means "including (or includes), but not limited to."

In this document, when terms such as "first" and "second" are used to modify a noun, such use is simply intended to distinguish one item from another, and is not intended to require a sequential order unless specifically stated.

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

Figure 1:
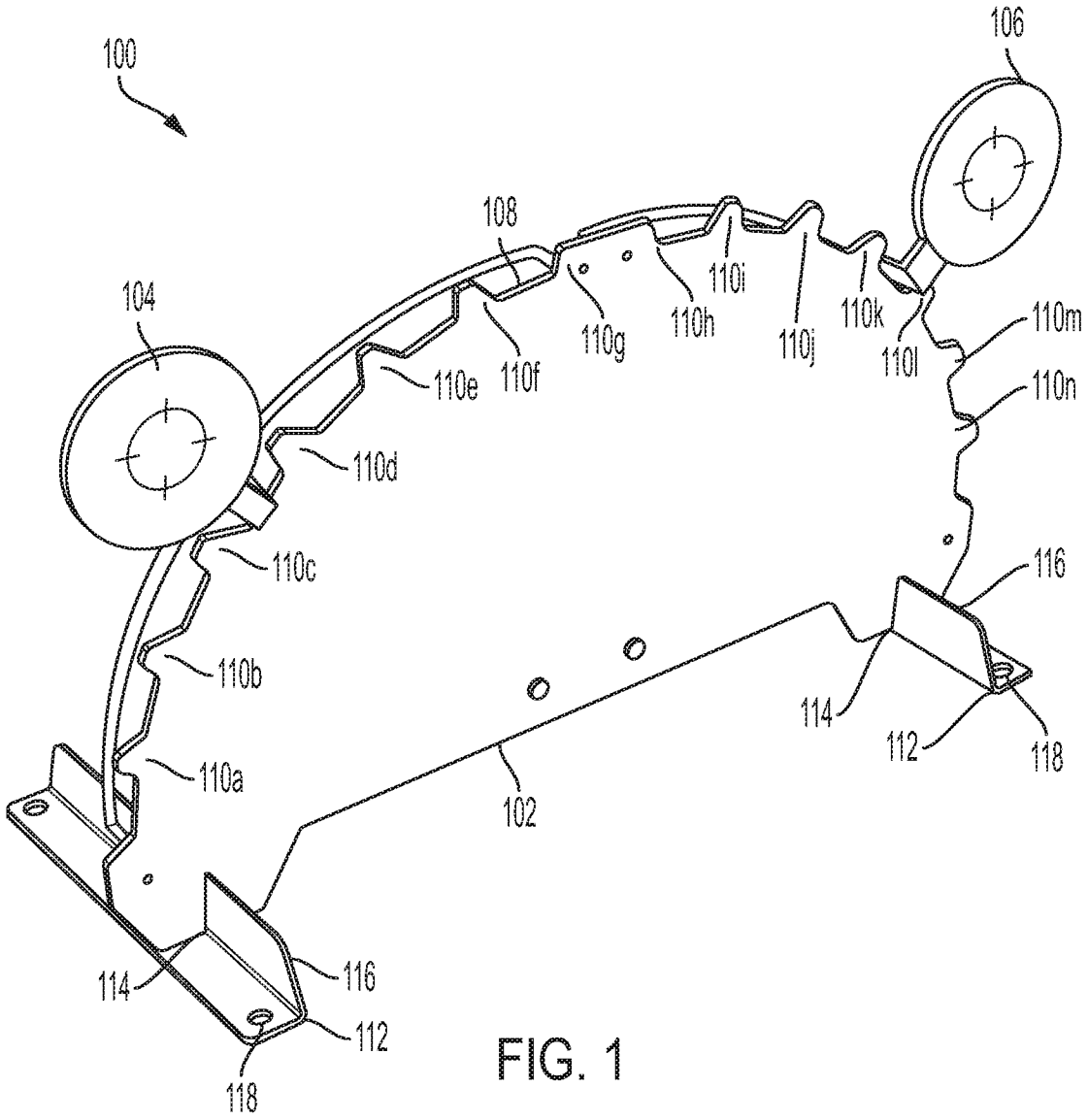
FIG. 1 illustrates a front perspective view of an example shooting target assembly according to an embodiment.

FIG. 1 illustrates an example shooting target assembly 100 according to an embodiment. As illustrated by FIG. 1, the shooting target assembly 100 includes a frame 102 and two targets 104, 106, each connected to a target arm 122, 124. Although two targets 104, 106 are shown, it is understood that additional and/or alternate number of targets may be used within the scope of this disclosure. For example, multiple targets may be connected to a target arm.

The frame 102 may have a generally semi-circular shape. For example, the frame 102 may have a rounded or curved top edge 108. In various embodiments, the frame may have catch mechanisms 110*a*-N located along the curved top edge 108. A catch mechanism 110*a*-N refers to a mechanism that is configured to stop the movement of a target arm (as described in more detail below). As illustrated in FIG. 1, a catch mechanism 110*a*-N may be a protrusion that extends outwardly from the top edge 108 of the frame 102.

A frame 102 may be configured to connect to one or more base members 112. A base member 112 may be used to position the frame 102 in a generally upright position. In certain embodiments, a frame 102 may be positioned such that it is angled relative to a base member. For example, the frame 102 may be positioned such that the angle between the frame and a base member 112 is between 60-90 degrees. By virtue of angling the frame 102, bullets that hit the targets may be deflected downward rather than outward.

Figure 2:
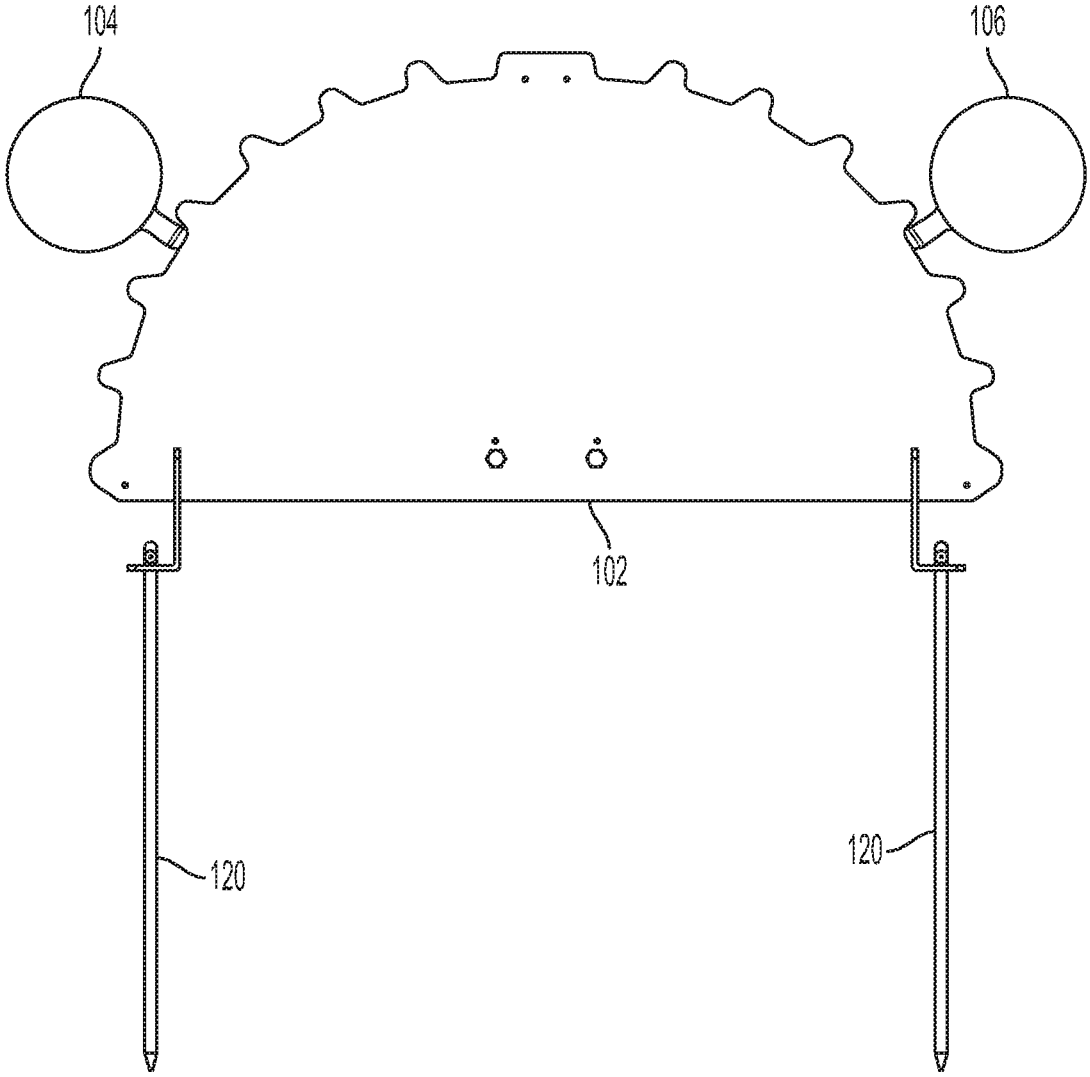
FIG. 2 illustrates an example shooting target assembly having a base member and legs.

A base member 112 may be configured to attach to a bottom portion of a frame 102. For example, as illustrated in FIG. 1, the frame 102 may have two vertically-oriented slots 114 located on its bottom portion, one near a left side of the frame and the other near a right side of the frame. A base member 112 may have a first portion 116 that is configured to be received by one or more of the slots 114. A base member 112 may have a second portion 118 configured to rest on a flat surface or to which one or more legs may be connected. For instance, the shooting target assembly 100 shown in FIG. 1 may be positioned on a flat surface. Alternatively, one or more legs 120 may be connected to one or more base members 112 to position the shooting target assembly 100 at a desired height, as illustrated in FIG. 2. In this embodiment, one or more legs 120 may connect to a base member such as, for example, via an opening, one or more screws or other fasteners and/or the like. Although FIG. 1 illustrates the use of two base members 112 with a shooting target assembly, it is understood that a singular base member may be used to position a shooting target assembly according to various embodiments.

A target 104, 106 may be connected to a target arm 122, 124. A target refers to a portion of the shooting target assembly that a marksman aims to hit. A target may be of various sizes or shapes. For instance, a target may be round, square, rectangular and/or the like.

Figure 3:
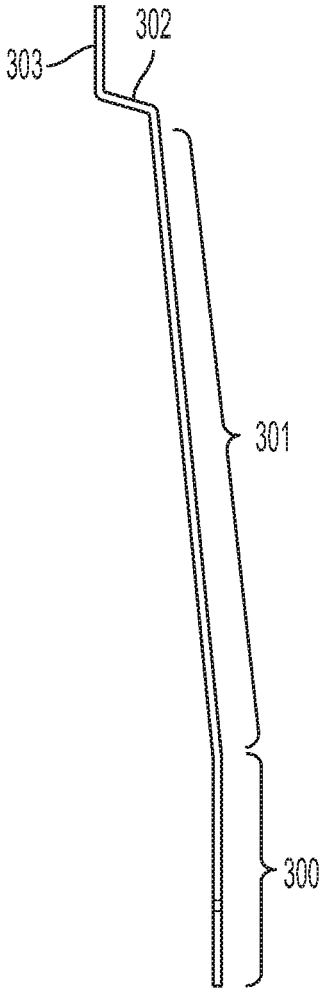
FIG. 3 illustrates a profile of an example target arm.

A target arm 122, 124 may have a first end 308 and a second end 306, as illustrated in FIG. 3, which shows a profile of an example target arm 122, 124 according to an embodiment. A target 104, 106 may be attached at or near a first end 308 of a target arm 122, 124. In an embodiment, the second end 306 of a target arm 122, 124 may be connected to the frame 102. For example, a second end 306 of a target arm 122, 124 may be connected to a rear portion 107 of the frame 102 such that the target 104, 106 that is attached to the target arm is positioned above the curved edge 108 of the frame 102.

As illustrated in FIG. 3, a target arm 122, 124 may have four portions 300, 301, 302, 303. A first portion 300 may extend in a generally vertical or upward direction, and may be configured to be positioned along at least a portion of the frame 102. A second portion 301 may be connected to the first portion 300 and may extend from the first portion at an angle. This angle may be between approximately 170-180 degrees. A third portion may be connected to the second portion 301 and may extend from the second portion 300 at an angle. This angle may be between approximately 100-115 degrees. A fourth portion 303 may be connected to the third portion 302 and may extend from the third portion at an angle. This angle may be between approximately 100-115 degrees.

When a target arm 122, 124 is attached to the frame 102, the second portion 302 is configured to extend outward from the frame 102 along an area of the upper edge 108 between two catch mechanisms 110*a*-N.

A third portion 304 may be attached to the second portion 302 at an angle such that the second portion 302 is generally parallel to the first portion 300 of the target arm 122, 124. The third portion 304 may be configured to attach to a rear portion of a target 104, 106 and may be configured to hold the target at a position generally above the top edge 108 of the frame 102. In various embodiments, the third portion 304 may be formed integrally with a target 104, 106. Alternatively, the third portion 304 may be removeably connected to a target 104, 106 via one or more fasteners such as, for example, brackets, screws, bolts and/or the like.

In various embodiments, a second end 306 of a target arm 122, 124 may be pivotally connected to a frame 102. FIG. 4 illustrates a rear side of the frame 102 according to an embodiment. As illustrated in FIG. 4, a target arm 122, 124 may be connected to the frame 102 at a location near the bottom center of the rear side of the frame 102.

Figure 5:
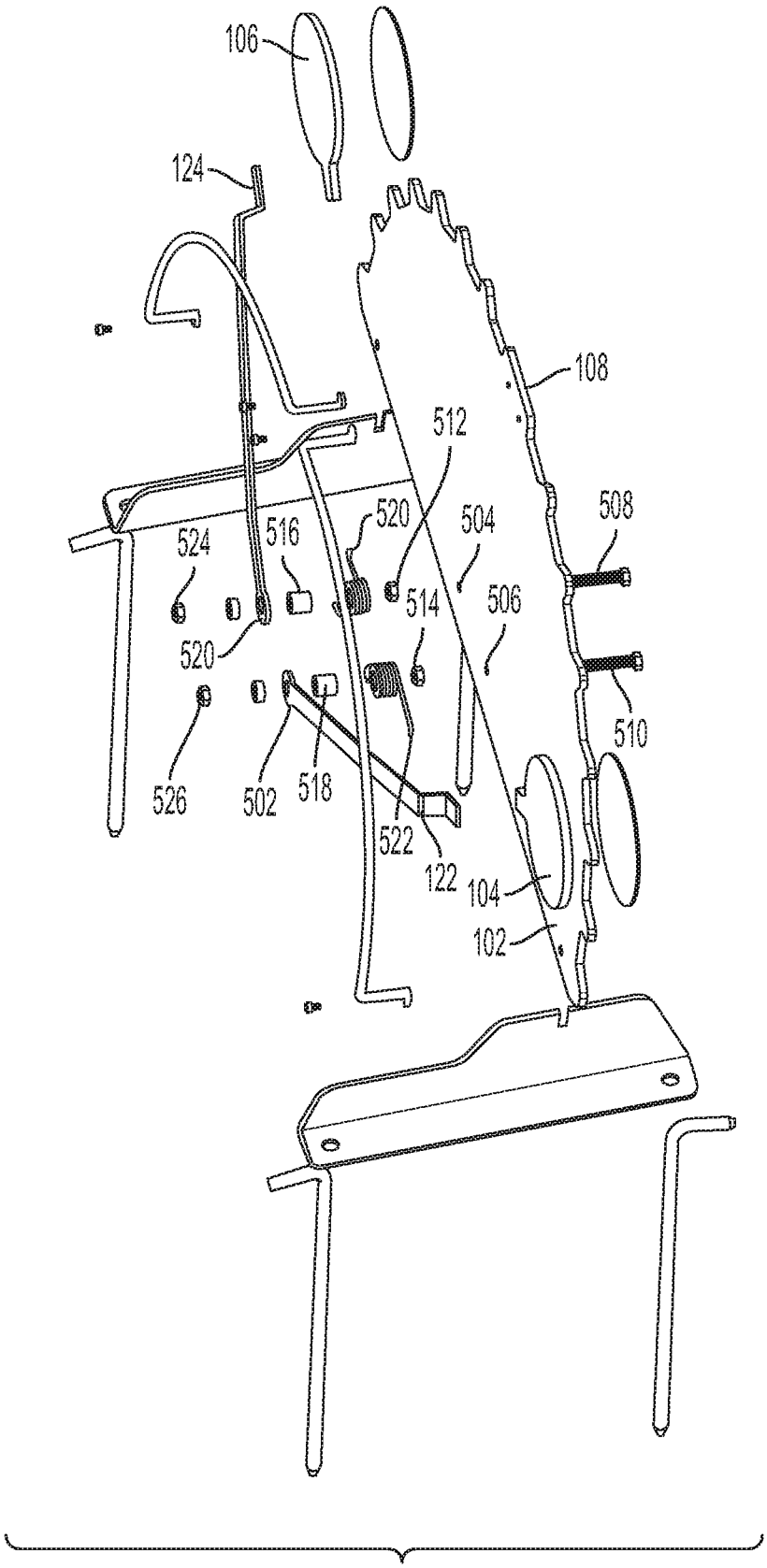
FIG. 5 illustrates an example connection of a target arm to a frame.

FIG. 5 illustrates an example way that a target arm 122, 124 may be connected to a frame 102 according to an embodiment. A target arm 122, 124 may have an aperture 500, 502 located near the second end 306 of the target arm. Similarly, the frame 102 may have two apertures 504, 506 located near the bottom that extend through the frame 100 from the front side to the rear side. A fastener 508, 510 such as a bolt, screw, pin and/or the like may extend from the front side of the frame to the rear side of the frame through one or more of the frame apertures. A lock nut 512, 514 may be positioned on the fastener against the rear side of the frame, and a spacer 516, 518, such as a nylon spacer, may be positioned on the fastener adjacent to the lock nut. A torsion spring 520, 522 may be positioned over the spacer 516, 518. An aperture 500, 502 of a target arm may be positioned along the fastener 508, 510 adjacent to the spacer 516, 518, and a lock nut 524, 526 may be used to secure a target arm 122, 124 to the frame.

The spacer 516, 518 and the torsion spring 520, 522 may allow a target arm 122, 124 to pivot about the frame 102. For example, as described in more detail below, when a target 104, 106 is hit, the impact may release the target from a current catch mechanism 110*a*-N. Once beyond the catch mechanism 110*a*-N, and when a target arm 122, 124 is not engaged by one of the catch mechanisms, the torsion spring 520, 522 may cause a target arm to rotate and thereby move a target 104, 106 along the upper edge 108 of the frame 102 until the target arm engages the next catch mechanism (or bar as described in more detail below). Each new impact moves the target 104, 106 beyond the current catch mechanism 110*a*-N until the target reaches the final catch mechanism.

Figure 4A:
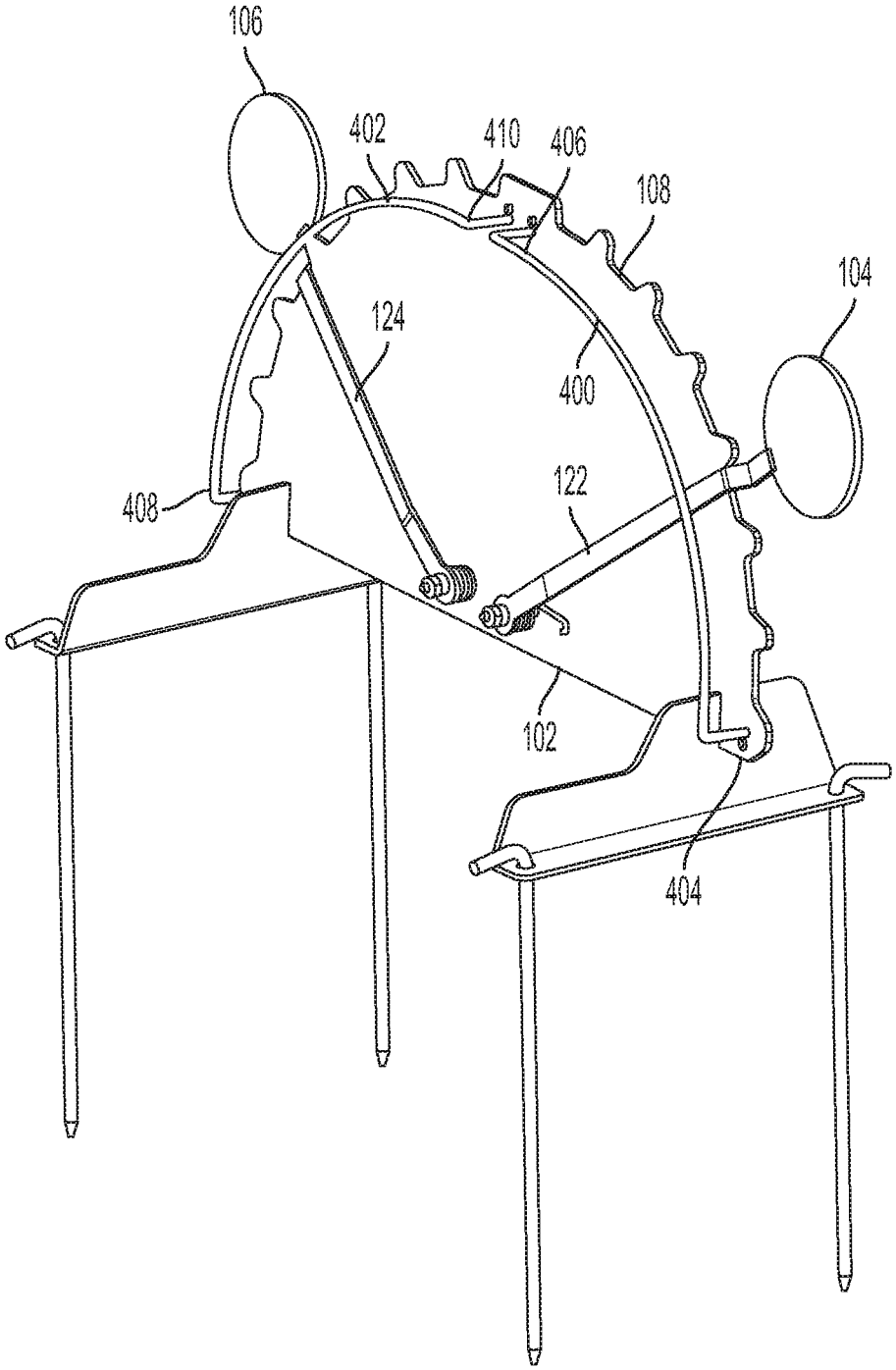
FIGS. 4A, 4B and 4C each illustrate a rear side of a shooting target assembly according to various embodiments.

In an embodiment, one or more bars may be mounted to the rear side 107 of the frame 102 to assist in the movement of the target arms 122, 124. For example, referring back to FIG. 4A, two bars 400, 402 may be mounted to the rear side 107 of the frame 102 to assist in the movement of the target arms 122, 124. For example, a bar 400, 402 may be mounted to a frame using screws, brackets, pins, other fasteners and/or the like. Each bar 400, 402 may be mounted to the frame 102 in a way such that a target arm 122, 124 is positioned between the frame and the bar. For example, as shown in FIG. 4A, a bar 400, 402 may extend outward from the rear side 107 of the frame 102 to provide a gap between the bar and the frame. A target arm 122, 124 may be positioned within this gap.

A first end 404 of a first bar 400 may be mounted to the frame 102 near a bottom corner of the rear side 107 of the frame. The second end 406 of the first bar 400 may be mounted to the frame 102 near a top center portion of the rear side 107 of the frame. The first bar 400 may have a generally curved shaped that corresponds to at least a portion of the top edge 108 of the frame 102.

Similarly, a first end 408 of a second bar 402 may be mounted to the frame 102 near a bottom corner of the rear side 107 of the frame that is opposite the corner where the first bar 400 is mounted. The second end 410 of the second bar 402 may be mounted to the frame 102 near a top center portion of the rear side 107 of the frame 102 in proximity to the second end 406 of the first bar 400.

The first bar 400 and the second bar 402 may serve to contain the movement of the target arms 122, 124 when their corresponding targets 104, 106 are hit. In addition, the second ends 404, 408 of the first and second bars (the ends mounted to the frame near a top center portion of the rear side of the frame) may serve to prevent the target arms 122, 124 from moving along the top edge 108 of the frame 102 beyond the second end.

Figure 4B:
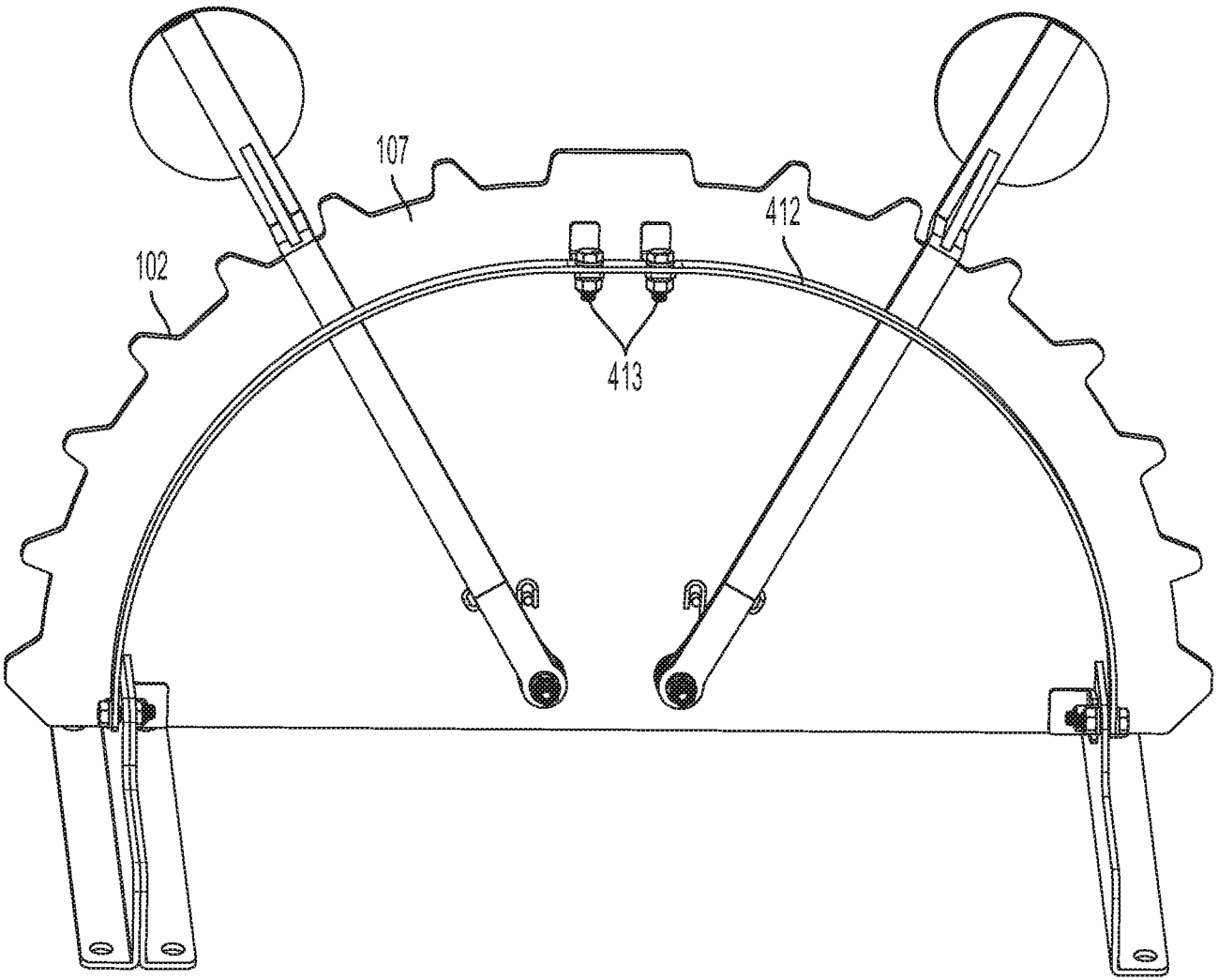

As another example, FIG. 4B illustrates an embodiment of an assembly having a single bar 412 with a curved shape. One end of the bar 412 may be mounted near a bottom corner of the rear side 107 of the frame 102, and the other end of the bar may be mounted near a bottom corner of the rear side of the frame that is opposite the corner where the first end is mounted. As illustrated by FIG. 4B, a top center portion of the bar 412 may be secured to the rear side 107 of the frame 102 by one or more connections 413 that may extend outwardly from the rear side of the frame.

Figure 4C:
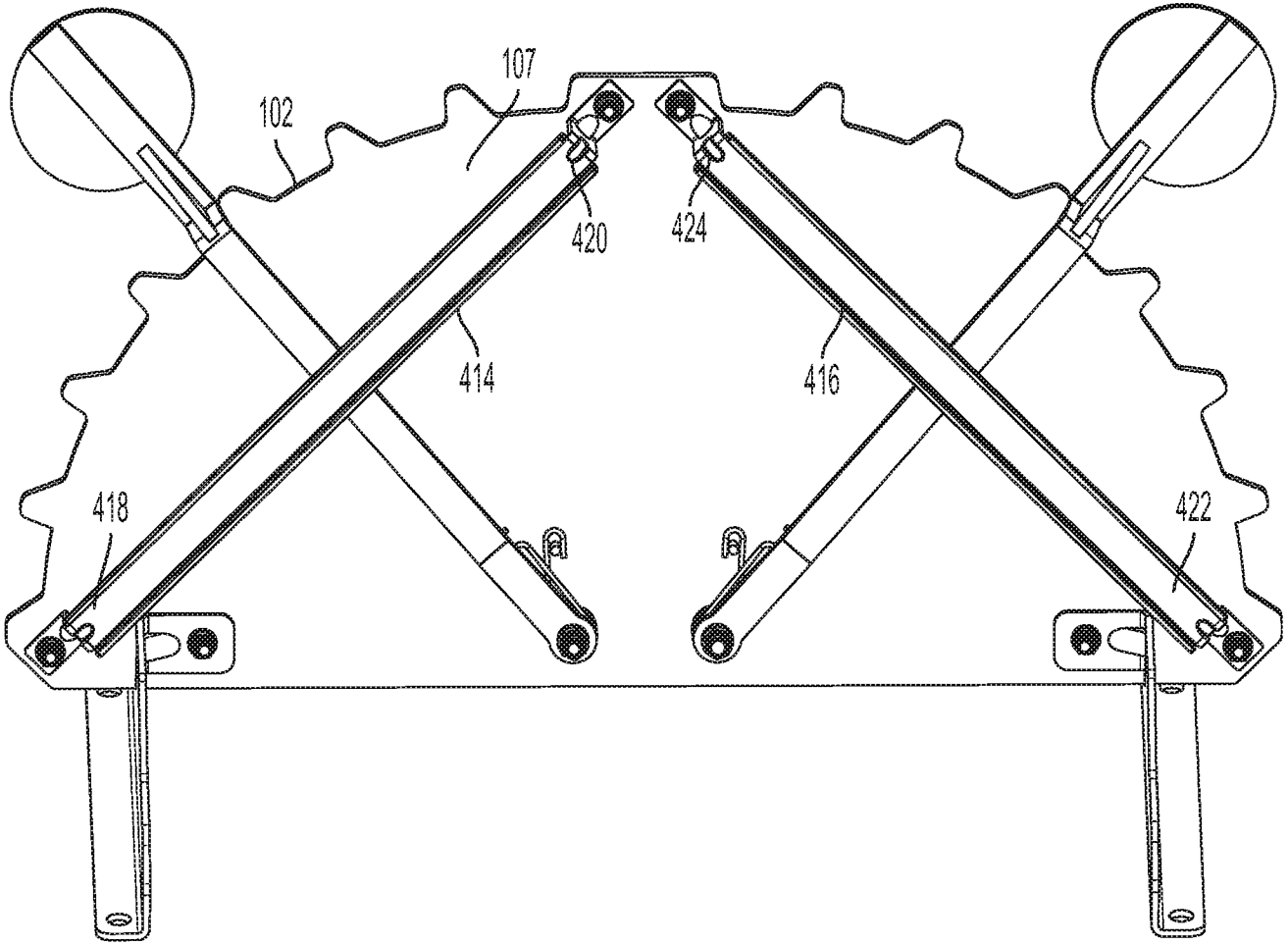

As another example, FIG. 4C illustrates an embodiment of an assembly having two linear bars 414, 416. A first end 418 of a first bar 414 may be mounted to the frame 102 near a bottom corner of the rear side 107 of the frame. The second end 420 of the first bar 414 may be mounted to the frame 102 near a top center portion of the rear side 107 of the frame.

Similarly, a first end 422 of a second bar 416 may be mounted to the frame 102 near a bottom corner of the rear side 107 of the frame that is opposite the corner where the first bar 414 is mounted. The second end 424 of the second bar 416 may be mounted to the frame 102 near a top center portion of the rear side 107 of the frame 102 in proximity to the second end 420 of the first bar 414.

The shooting target assembly 100 may be used as part of competitive shooting challenges between two marksmen. The shooting target assembly 100 may be configured at the beginning of the challenge such that one target 104, 106 is positioned near the bottom left side of the frame 102 and the other target 104, 106 is positioned near the bottom ride side of the frame. For example, one target arm 104, 106 may be positioned to engage a bottom-most catch mechanism on the left side of the frame 102, while the other target arm 104, 106 may be positioned to engage a bottom-most catch mechanism 110*a*-N on the right side of the frame. Each of the two marksmen may aim to hit only one of targets 104, 106. For example, one marksman may aim to hit the target 104, 106 on the left while the other marksman may aim to hit the target on the right.

When a marksman hits a target 104, 106, the impact pushes the target beyond the current catch mechanism 110*a*-N. The torsion spring 520, 522 moves the target 104, 106 along the upper edge 108 of the frame 102 to the next catch mechanism. This process is repeated until one marksman hits the target 104, 106 a sufficient number of times to move the corresponding target arm 122, 124 to the final catch mechanism 110*a*-N. A bar 400, 402 may then prevent the target arm 122, 124 from moving any further along the top edge 108 of the frame 102, even if the target is hit again. The marksman whose target 104, 106 reaches the top first wins.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. A shooting target assembly comprising:

a frame having a curved edge, wherein a plurality of catch mechanisms are positioned along the curved edge;

a first target arm comprising:

a first end and a second end, wherein the first end of the first target arm is connected to a first target that is positioned above the curved edge, wherein the second end of the first target arm is pivotally connected to a rear portion of the frame at a first pivot point, a first portion configured to extend along at least a portion of the rear portion of the frame, a second portion attached to the first portion, wherein the second portion is configured to extend along at least a second portion of the rear portion of the frame, a third portion attached to the second portion, wherein the second portion is angled relative to the second portion and is configured to extend over the curved edge, and a fourth portion attached to the third portion, wherein the fourth portion is angled relative to the third portion and is configured to extend above the curved edge, wherein the first target is connected to the fourth portion; and a second target arm comprising a first end and a second end, wherein:

the first end of the second target arm is connected to a second target that is positioned above the curved edge, and the second end of the second target arm is pivotally connected to the rear portion of the frame at a second pivot point, wherein each of the plurality of catch mechanisms is configured to engage the first target arm or the second target arm.

2. The shooting target assembly of claim 1, wherein the second end of the first target arm is connected to a torsion spring.

3. The shooting target assembly of claim 2, wherein the torsion spring is configured to rotate the first target arm about the first pivot point when the first target arm is not engaged by one of the plurality of catch mechanisms.

4. The shooting target assembly of claim 1, wherein the second end of the second target arm is connected to a torsion spring.

5. The shooting target assembly of claim 4, wherein the torsion spring is configured to rotate the second target arm about the second pivot point when the second target arm is not engaged by one of the plurality of catch mechanisms.

6. The shooting target assembly of claim 1, further comprising a first bar connected to the rear portion of the frame, wherein the first bar extends over the first target arm.

7. The shooting target assembly of claim 6, wherein at least a portion of the first bar is configured to restrict movement of the first target arm.

8. The shooting target assembly of claim 6, further comprising a second bar connected to the rear portion of the frame, wherein the second bar extends over the second target arm.

9. The shooting target assembly of claim 8, wherein at least a portion of the second bar is configured to restrict movement of the second arm.

10. The shooting target assembly of claim 1, further comprising a curved bar connected to the rear portion of the frame, wherein the curved bar is configured to restrict movement of the first arm and the second arm.

11. The shooting target assembly of claim 1, further comprising a base portion attached to at least a portion of a bottom portion of the frame such that the frame is positioned at an angle relative to the base portion.

12. The shooting target assembly of claim 11, further comprising one or more legs connected to the base portion.

13. The shooting target assembly of claim 1, wherein the second target arm comprises:

a first portion configured to extend along at least a third portion of the rear portion of the frame;

a second portion attached to the first portion of the second target arm, wherein the second portion of the second target arm is configured to extend along at least a fourth portion of the rear portion of the frame;

a third portion attached to the second portion of the second target arm, wherein the third portion of the second target arm is angled relative to the second portion of the second target arm and is configured to extend over the curved edge; and a fourth portion attached to the third portion of the second target arm, wherein the fourth portion of the second target arm is angled relative to the third portion of the second target arm and is configured to extend above the curved edge, wherein the second target is connected to the fourth portion of the second target arm.

14. A shooting target assembly comprising:

a frame having a curved edge, wherein a plurality of catch mechanisms are positioned along the curved edge;

a first target arm comprising:

a first end and a second end, wherein the first end of the first target arm is connected to a first target that is positioned above the curved edge, the second end of the first target arm is pivotally connected to a rear portion of the frame at a first pivot point, a first portion configured to extend along at least a portion of the rear portion of the frame, a second portion attached to the first portion, wherein the second portion is configured to extend along at least a second portion of the rear portion of the frame, a third portion attached to the second portion, wherein the second portion is angled relative to the second portion and is configured to extend over the curved edge, and a fourth portion attached to the third portion, wherein the fourth portion is angled relative to the third portion and is configured to extend above the curved edge, wherein the first target is connected to the fourth portion; and a second target arm comprising a first end and a second end, wherein:

the first end of the second target arm is connected to a second target that is positioned above the curved edge, the second end of the second target arm is pivotally connected to the rear portion of the frame at a second pivot point, at least one bar mounted to the rear portion of the frame such that the at least one bar extends over at least one of the first target arm or the second target arm;

wherein each of the plurality of catch mechanisms is configured to engage the first target arm or the second target arm.

15. The shooting target assembly of claim 14, wherein the second end of the first target arm is connected to a torsion spring, wherein the torsion spring is configured to rotate the first target arm about the first pivot point when the first target arm is not engaged by one of the plurality of catch mechanisms.

16. The shooting target assembly of claim 14, wherein the second end of the second target arm is connected to a torsion spring, wherein the torsion spring is configured to rotate the second target arm about the second pivot point when the second target arm is not engaged by one of the plurality of catch mechanisms.

17. The shooting target assembly of claim 14, further comprising:

a base portion attached to at least a portion of a bottom portion of the frame such that the frame is positioned at an angle relative to the base portion; and one or more legs connected to the base portion.

18. The shooting target assembly of claim 14, wherein the second target arm comprises:

a first portion configured to extend along at least a third portion of the rear portion of the frame;

a second portion attached to the first portion of the second target arm, wherein the second portion of the second target arm is configured to extend along at least a fourth portion of the rear portion of the frame;

a third portion attached to the second portion of the second target arm, wherein the third portion of the second target arm is angled relative to the second portion of the second target arm and is configured to extend over the curved edge; and a fourth portion attached to the third portion of the second target arm, wherein the fourth portion of the second target arm is angled relative to the third portion of the second target arm and is configured to extend above the curved edge, wherein the second target is connected to the fourth portion of the second target arm.

19. A shooting target assembly comprising:

a frame having a curved edge, wherein a plurality of catch mechanisms are positioned along the curved edge;

a first target arm comprising a first end and a second end, wherein:

the first end of the first target arm is connected to a first target that is positioned above the curved edge, the second end of the first target arm is pivotally connected to a rear portion of the frame at a first pivot point, a second target arm comprising:

a first end and a second end, wherein the first end of the second target arm is connected to a second target that is positioned above the curved edge, wherein the second end of the second target arm is pivotally connected to the rear portion of the frame at a second pivot point, a first portion configured to extend along at least a portion of the rear portion of the frame, a second portion attached to the first portion, wherein the second portion is configured to extend along at least a second portion of the rear portion of the frame, a third portion attached to the second portion, wherein the third portion is angled relative to the second portion and is configured to extend over the curved edge, and a fourth portion attached to the third portion, wherein the fourth portion is angled relative to the third portion and is configured to extend above the curved edge, wherein the second target is connected to the fourth portion, wherein each of the plurality of catch mechanisms is configured to engage the first target arm or the second target arm.

20. A shooting target assembly comprising:

a frame having a curved edge, wherein a plurality of catch mechanisms are positioned along the curved edge;

a first target arm comprising a first end and a second end, wherein the first end of the first target arm is connected to a first target that is positioned above the curved edge, wherein the second end of the first target arm is pivotally connected to a rear portion of the frame at a first pivot point, a second target arm comprising:

a first end and a second end, wherein the first end of the second target arm is connected to a second target that is positioned above the curved edge, wherein the second end of the second target arm is pivotally connected to the rear portion of the frame at a second pivot point, a first portion configured to extend along at least a portion of the rear portion of the frame, a second portion attached to the first portion, wherein the second portion is configured to extend along at least a second portion of the rear portion of the frame, a third portion attached to the second portion, wherein the third portion is angled relative to the second portion and is configured to extend over the curved edge, and a fourth portion attached to the third portion, wherein the fourth portion is angled relative to the third portion and is configured to extend above the curved edge, wherein the second target is connected to the fourth portion; and at least one bar mounted to the rear portion of the frame such that the at least one bar extends over at least one of the first target arm or the second target arm;

wherein each of the plurality of catch mechanisms is configured to engage the first target arm or the second target arm.

* * * * *